US007854018B1

(12) United States Patent
Meske

(10) Patent No.: US 7,854,018 B1
(45) Date of Patent: Dec. 21, 2010

(54) GOLF GLOVE PATCH SYSTEM

(76) Inventor: Kurt A. Meske, 29453 Coharie Loop, San Antonio, FL (US) 33576

( * ) Notice: Subject to any disclaimer, the term of this patent is extended or adjusted under 35 U.S.C. 154(b) by 623 days.

(21) Appl. No.: 11/986,009

(22) Filed: Nov. 19, 2007

Related U.S. Application Data

(60) Provisional application No. 60/900,195, filed on Feb. 12, 2007.

(51) Int. Cl.
*A41D 19/00* (2006.01)

(52) U.S. Cl. ..... 2/161.2; 2/160

(58) Field of Classification Search ..... None
See application file for complete search history.

(56) References Cited

U.S. PATENT DOCUMENTS 3,965,488 A * 6/1976 Paulucci ..... 2/160
4,732,633 A * 3/1988 Pokorny ..... 156/94
5,167,613 A 12/1992 Karami et al.
5,714,208 A * 2/1998 Ferrell et al. ..... 427/558
D513,639 S 1/2006 Saim et al.

* cited by examiner

*Primary Examiner*—Katherine Moran

(57) ABSTRACT

A golf glove patch system has a backing sheet fabricated of a plastic material, a patch with a lower and an upper surface and with a peripheral edge taking a geometric shape, and an adhesive secured to the lower surface of the patch adjacent to its peripheral edge with a central free of adhesive. The patch is temporarily coupled to the backing sheet through the adhesive and is adapted to be removed from the backing sheet and placed on the glove and secured to the glove by the adhesive. The central extent of the patch is over a tear in the glove and is in contact with a portion of a user's hand.

7 Claims, 2 Drawing Sheets

FIG 1
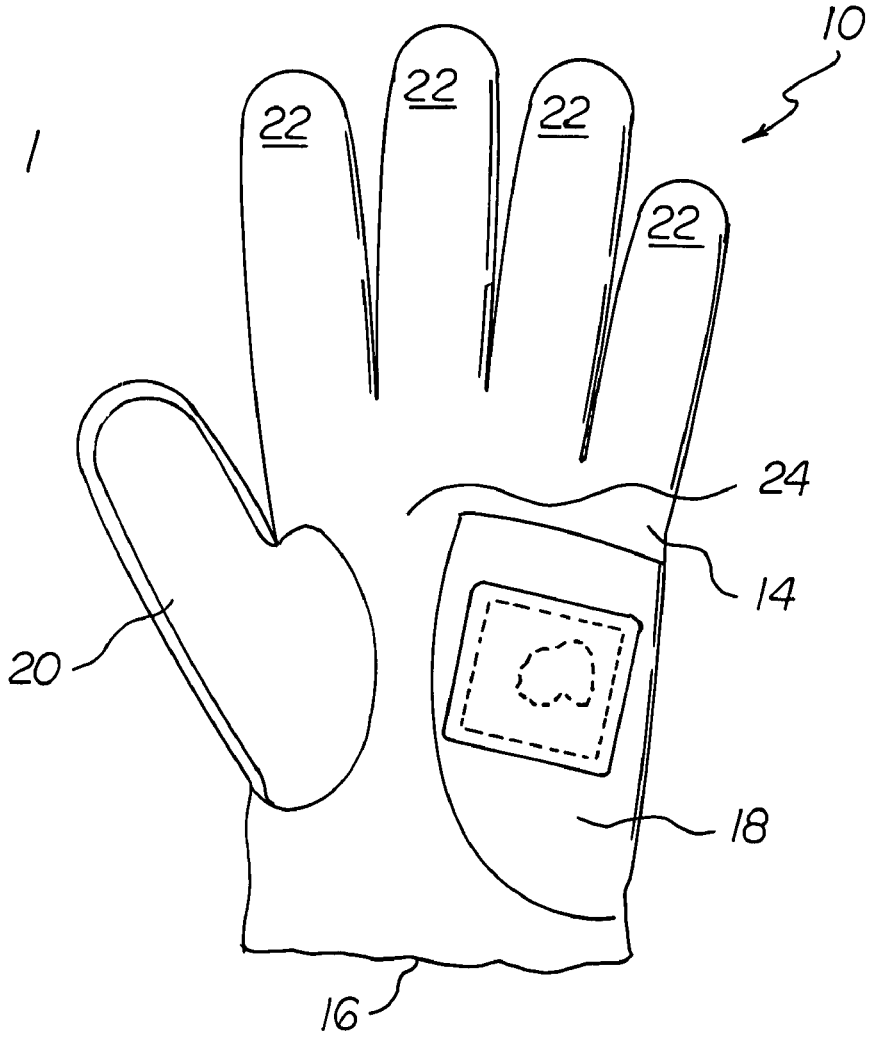
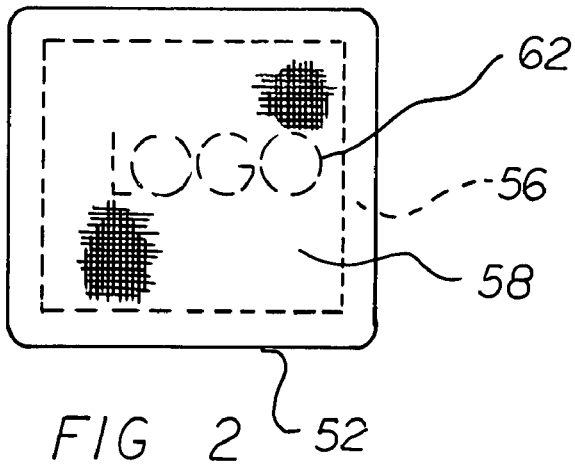
FIG 2

FIG 3
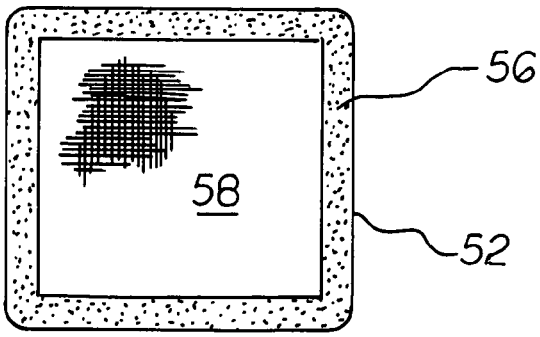
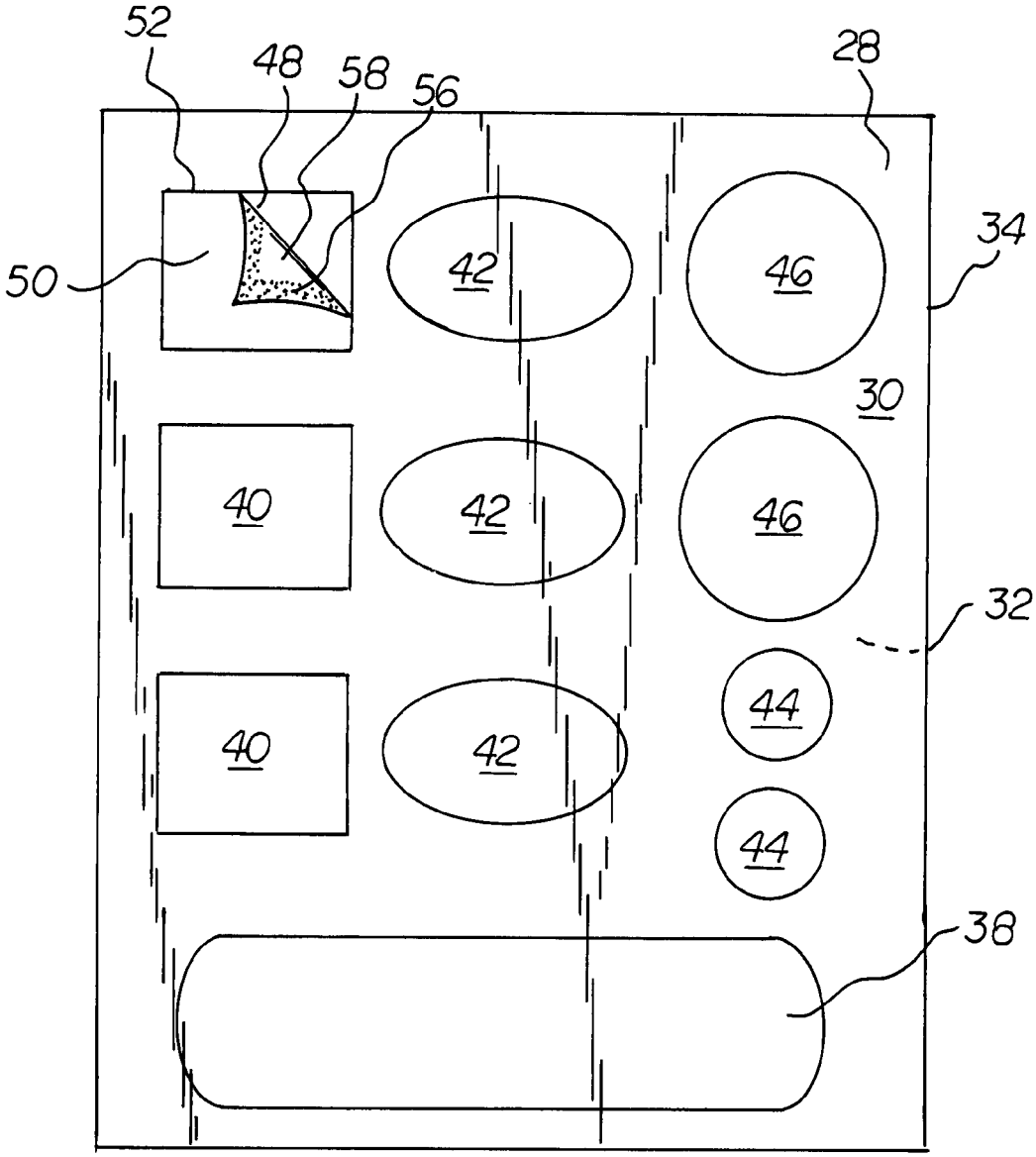
FIG 4

GOLF GLOVE PATCH SYSTEM

RELATED APPLICATION

This application is based upon Provisional Patent Application No. 60/900,195 filed Feb. 12, 2007, the subject matter of which is incorporated herein by reference.

BACKGROUND OF THE INVENTION

1. Field of the Invention

The present invention relates to a golf glove patch system and more particularly pertains to facilitating the convenient repair of a golf glove.

2. Description of the Prior Art

The use of glove repair systems is known in the prior art. More specifically, glove repair systems previously devised and utilized for the purpose of repairing worn or torn gloves are known to consist basically of familiar, expected, and obvious structural configurations, notwithstanding the myriad of designs encompassed by the crowded prior art which has been developed for the fulfillment of countless objectives and requirements.

By way of example, U.S. Pat. No. D513,639 issued Jan. 17, 2006, to Saim et al. discloses an adhesive patch. U.S. Pat. No. 5,167,613 issued Dec. 1, 1992, to Karami et al. discloses a Composite Vented Wound Dressing. Lastly, U.S. Pat. No. 4,732,633 issued Mar. 22, 1988 to Pokorny discloses a Method of Patching Damaged Sheet Material.

While these devices fulfill their respective, particular objectives and requirements, the aforementioned patents do not describe a golf glove patch system that facilitates the convenient repair of a golf glove.

In this respect, the golf glove patch system according to the present invention substantially departs from the conventional concepts and designs of the prior art, and in doing so provides an apparatus primarily developed for the purpose of facilitating the convenient repair of a golf glove.

Therefore, it can be appreciated that there exists a continuing need for a new and improved golf glove patch system which can be used for facilitating the convenient repair of a golf glove. In this regard, the present invention substantially fulfills this need.

SUMMARY OF THE INVENTION

In view of the foregoing disadvantages inherent in the known types of glove repair systems now present in the prior art, the present invention provides an improved golf glove patch system. As such, the general purpose of the present invention, which will be described subsequently in greater detail, is to provide a new and improved golf glove patch system and method which has all the advantages of the prior art and none of the disadvantages.

To attain this, the present invention essentially comprises a golf glove positionable on the left hand of a user. The golf glove has an aperture for the passage of the user's hand when donning and removing the golf glove with respect to a user's hand. The golf glove also has a palm section and a thumb section. The palm and thumb sections are fabricated of a soft, thin, cabretta leather with a thickness of between 0.003 and 0.007 inches. The golf glove also has four finger sections and additional sections coupling the fingers and thumb and palm sections. The finger and additional sections are fabricated of an elastomeric material selected from the class of elastomeric materials including plastic and rubber, natural and synthetic, and blends thereof. The elastomeric material has a thickness of between 0.003 and 0.007 inches.

Next provided is a backing sheet. The backing sheet is fabricated of an acetate plastic material with limited flexibility. The backing sheet is in a rectangular configuration with a front face and a rear face and with a peripheral edge.

Next provided are a plurality of patches. The patches are fabricated of cabretta leather having a thickness of between about 0.003 and 0.007 inches. The patches are configured with a lower surface and an upper surface and with a peripheral edge. The peripheral edge takes a geometric shape selected from the class of geometric shapes including a rectangle, a square, an oval, a small circle, and a large circle.

Next provided is an athletic adhesive. The adhesive is secured to the lower surface of each of the patches adjacent to its entire peripheral edge. A central extent of the patch is free of adhesive. The adhesive is of a common width around the entire periphery and covers between 25 percent and 50 percent of the surface area of the lower surface of the patch. Each of the patches are temporarily coupled to the backing sheet through the athletic adhesive. Each of the patches is adapted to be removed from the backing sheet and placed on the glove and secured to the glove by the adhesive in both areas of the cabretta leather as well as to other areas of the glove. The central extent of the patch is placed over a tear in the glove in contact with a portion of a user's hand.

Lastly, indicia is provided on the exterior surface of each of the patches. The indicia is viewed when the patch is placed on and secured to the glove.

One of the most common problems with a golf glove is that a hole can occur in the fabric, commonly a natural or synthetic leather. Once a hole develops, it becomes larger and larger with time and eventually makes the golf glove unusable. A hole in a golf glove can impair the user's desired grip of the club. The present invention prolongs the use of the glove. The patch is to cover a hole in a golf glove caused by friction between the golf glove and golf club grip from use. The patch is peeled off of a backing exactly like a sticker or bandage and is stuck onto a golf glove where a hole has been produced by wear and tear. The patch has one side which is a piece of leather and another side with a pad surrounded by a periphery with adhesive, much like a medical bandage. The pad on the adhesive side is positioned directly over the hole in the golf glove so that the user's hand inside of the glove is not stuck to the adhesive.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf glove patch system which has all of the advantages of the prior art glove repair systems and none of the disadvantages.

It is another object of the present invention to provide a new and improved golf glove patch system which may be easily and efficiently manufactured and marketed.

It is further object of the present invention to provide a new and improved golf glove patch system which is of durable and reliable constructions.

An even further object of the present invention is to provide a new and improved golf glove patch system which is susceptible of a low cost of manufacture with regard to both materials and labor, and which accordingly is then susceptible of low prices of sale to the consuming public, thereby making such golf glove patch system economically available to the buying public.

Even still another object of the present invention is to provide a golf glove patch system for facilitating the convenient repair of a golf glove.

Lastly, it is an object of the present invention to provide a new and improved golf glove patch system having a golf glove, a backing sheet fabricated of a plastic material, a patch with a lower and an upper surface and with a peripheral edge taking a geometric shape, an adhesive secured to the lower surface of the patch adjacent to its peripheral edge with a central area free of adhesive. The patch is temporarily coupled to the backing sheet through the adhesive and is adapted to be removed from the backing sheet and placed on the glove and secured to the glove by the adhesive. The central extent of the patch is over a tear in the glove and is in contact with a portion of a user's hand.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a golf glove patch system constructed in accordance with the principles of the present invention.

FIG. 2 is an enlarged front elevational view of the patch shown in FIG. 1.

FIG. 3 is an enlarges rear elevational view of the patch shown in FIGS. 1 and 2.

FIG. 4 is a plurality of patches of various sizes and shapes positioned upon on a backing sheet in anticipation of usage.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved golf glove patch system embodying the principles and concepts of the present invention and generally designated by the reference numeral 10 will be described.

The present invention, the golf glove patch system 10 is comprised of a plurality of components. Such components in their broadest context include a golf glove, a backing sheet, a patch and an adhesive. Such components are individually configured and correlated with respect to each other so as to attain the desired objective.

First provided is a golf glove 14. The golf glove is positionable on the left hand of a user. The golf glove has an aperture 16 for the passage of the user's hand when donning and removing the golf glove with respect to a user's hand. The golf glove also has a palm section 18 and a thumb section 20. The palm and thumb sections are fabricated of a soft, thin, cabretta leather with a thickness of between 0.003 and 0.007 inches. The golf glove also has four finger sections 22 and additional sections 24 coupling the fingers and thumb and palm sections. The finger and additional sections are fabricated of an elastomeric material selected from the class of elastomeric materials including plastic and rubber, natural and synthetic, and blends thereof. The elastomeric material has a thickness of between 0.003 and 0.007 inches.

Next provided is a backing sheet 28. The backing sheet is fabricated of an acetate plastic material with limited flexibility. The backing sheet is in a rectangular configuration with a front face 30 and a rear face 32 and with a peripheral edge 34.

Next provided are a plurality of patches 38, 40, 42, 44, 46. The patches are fabricated of cabretta leather having a thickness of between about 0.003 and 0.007 inches. The patches are configured with a lower surface 48 and an upper surface 50 and with a peripheral edge 52. The peripheral edge takes a geometric shape selected from the class of geometric shapes including a rectangle 38, a square 40, an oval 42, a small circle 44, and a large circle 46.

Next provided is an athletic adhesive 56. The adhesive is secured to the lower surface of each of the patches adjacent to its entire peripheral edge. A central extent 58 of the patch is free of adhesive. The adhesive is of a common width around the entire periphery and covers between 25 percent and 50 percent of the surface area of the lower surface of the patch. Each of the patches are temporarily coupled to the backing sheet through the athletic adhesive. Each of the patches is adapted to be removed from the backing sheet and placed on the glove and secured to the glove by the adhesive in both areas of the cabretta leather as well as to other areas of the glove. The central extent of the patch is placed over a tear in the glove in contact with a portion of a user's hand.

Lastly, indicia 62 is provided on the exterior surface of each of the patches. The indicia is viewed when the patch is placed on and secured to the glove.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art of golf, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf glove patch system comprising:

a golf glove;

a backing sheet fabricated of a plastic material with a front and a rear face;

a patch with a lower and an upper surface and with a peripheral edge taking a geometric shape; and an adhesive secured to the lower surface of the patch adjacent to its peripheral edge with a central extent free of adhesive, the patch being temporarily coupled to the backing sheet through the athletic adhesive, the patch adapted to be removed from the backing sheet and placed on the glove and secured to the glove by the adhesive with the central extent of the patch over a tear in the glove in contact with a portion of a user's hand.

2. The system as set forth in claim 1 and further including indicia on the exterior surface of the patches for being viewed when placed on and secured to the glove.

3. The system as set forth in claim 1 wherein the adhesive is an athletic adhesive.

4. The system as set forth in claim 1 wherein the glove is positionable on the hand of a user, the golf glove also having a palm section and a thumb section, the palm and thumb sections being fabricated of a soft, thin, cabretta leather with a thickness of between 0.003 and 0.007 inches, the golf glove also having four finger sections and additional sections coupling the fingers and thumb and palm sections, the finger and additional sections being fabricated of an elastomeric material selected from the class of elastomeric material including plastic and rubber, natural and synthetic, and blends thereof, the elastomeric material having a thickness of between 0.003 and 0.007 inches.

5. The system as set forth in claim 1 wherein the adhesive is of a common width around the entire periphery and covers between 25 percent and 50 percent of the surface area of the lower surface of the patch.

6. The system as set forth in claim 1 wherein the backing sheet is fabricated of an acetate plastic material with limited flexibility, the backing sheet having a rectangular configuration with a front face and a rear face and with a peripheral edge of a size to receive and support a plurality of patches.

7. A golf glove patch system for facilitating the repair of a golf glove in a reliable, convenient, economical manner comprising, in combination:

a golf glove positionable on the left hand of a user, the golf glove having an aperture for the passage of the user's hand when donning and removing the golf glove with respect to a user's hand, the golf glove also having a palm section and a thumb section, the palm and thumb sections being fabricated of a soft, thin, cabretta leather with a thickness of between 0.003 and 0.007 inches, the golf glove also having and four finger sections and additional sections coupling the fingers and thumb and palm sections, the finger and additional sections being fabricated of an elastomeric material selected from the class of elastomeric material including plastic and rubber, natural and synthetic, and blends thereof, the elastomeric material having a thickness of between 0.003 and 0.007 inches;

a backing sheet fabricated of an acetate plastic material with limited flexibility, the backing sheet having a rectangular configuration with a front face and a rear face and with a peripheral edge;

a plurality of patches fabricated of cabretta leather having a thickness of between about 0.003 and 0.007 inches, the patches configuration with a lower surface and an upper surface 50 and with a peripheral edge, the peripheral edge taking a geometric shape selected from the class of geometric shapes including a rectangle, a square, an oval, a small circle, and a large circle;

an athletic adhesive secured to the lower surface of each of the patches adjacent to its entire peripheral edge with a central extent of the patch being free of adhesive, the adhesive being of a common width around the entire periphery and covering between 25 percent and 50 percent of the surface area of the lower surface of the patch, each of the patches being temporarily coupled to the backing sheet through the athletic adhesive, each of the patches adapted to be removed from the backing sheet and placed on the glove and secured to the glove by the adhesive in both areas of the cabretta leather as well as to other areas of the glove with the central extent of the patch over a tear in the glove in contact with a portion of a user's hand; and indicia on the exterior surface of each of the patches for being viewed when placed on and secures to the glove.

* * * * *